United States Patent [19]

Grazer

[11] Patent Number: 4,758,696

[45] Date of Patent: Jul. 19, 1988

[54] SAFETY RECEPTACLE FOR A TWO-PIECE DUPLEX

[76] Inventor: David T. F. Grazer, 1340 Andover Rd., Bethlehem, Pa. 18018

[21] Appl. No.: 911,975

[22] Filed: Sep. 26, 1986

[51] Int. Cl.[4] ..... H01R 3/00

[52] U.S. Cl. ..... 200/51.09; 200/153 P

[58] Field of Search ..... 200/51.09, 153 P, 51.12, 200/51 R

[56] References Cited

U.S. PATENT DOCUMENTS

| | | | |
|---|---|---|---|
| 1,157,310 | 10/1915 | Klein | 200/153 P |
| 1,365,729 | 1/1921 | Sachs | 200/51.09 |
| 3,596,019 | 7/1971 | Koester | 200/51.09 |
| 3,701,074 | 10/1972 | Oster | 200/51.09 |

FOREIGN PATENT DOCUMENTS

| | | | |
|---|---|---|---|
| 210352 | 5/1909 | Fed. Rep. of Germany | 200/51 R |
| 316710 | 8/1917 | Fed. Rep. of Germany | 200/51 R |
| 1299673 | 6/1962 | France | 200/153 P |
| 308951 | 4/1929 | United Kingdom | 200/51 R |

*Primary Examiner*—Renee S. Luebke
*Attorney, Agent, or Firm*—Ruth Moyerman

[57] ABSTRACT

A safety receptacle for a two-piece duplex is disclosed. A pin is removably attached to a conventional male electric plug so that the pin extends outward in the same direction as the male plug's blades. A female electrical receptacle having at least one pair of hot/neutral slots encased in a housing, and adapted to receive the male blades, also includes a sleeve adapted to receive the pin.

A nonconductive, spring tensioned rack and pinion gear assembly is aligned to be workably connected to the pin. Each arm of a conductive pair of pivotal arms is connected at its one end to an electrical source and to the pinion. Each arm is aligned at its other end to make electrical contact with one of the pair of male blades so that when the pin is inserted into the sleeve, the pin engages and retracts the rack to a tensioned position, causing the pinion to rotate and pivot each of the arms into contact with the corresponding slot and thereby render the socket live. Removal of the male plug, and consequently the pin, causes the spring to relax, thereby urging the rack forward, causing each of the arms to pivot and break contact with the corresponding slot housing, thereby rendering the socket dead.

10 Claims, 3 Drawing Sheets

SAFETY RECEPTACLE FOR A TWO-PIECE DUPLEX

BACKGROUND OF THE INVENTION

1. Field of the Invention

This invention relates to a safety receptacle for a two-piece duplex, and more particularly to a receptacle which will not conduct electricity until a predetermined operation has been performed.

2. Description of the Prior Art

A matter of recognized danger is the presence of young childrn is the possibility of an electrical shock resulting when one inserts a metal object into an energized electrical outlet or when one's finger becomes lodged between the face plate and energized blades.

Suggestions for safeguards are often of a character which involves unusual modes of operation by an adult user, and their removal may be suggested when there is no longer a need for such precautions. Other devices are costly and complicated with many movable parts that are subject to malfunction. The following patents disclose the aforementioned problems:

U.S. Pat. No. 2,610,999 to Silver discloses a device requiring pressure on the exposed face of a finger engaging portion of a respective slide member against the action of a respective spring which causes the slots the slide member to be aligned with the usual openings to receive plug blades.

U.S. Pat. No. 2,770,786 to Chelton discloses alternate blocking plates moved into position by the insertion of the prongs.

U.S. Pat. No. 3,775,726 to Gress discloses a lateral translation of the plug and related portions of the receptable to cause fixed pins within the receptacle housing to extend into the holes in the plug blades and thereby lock the plug in place. Translation of the plug and related portions of the receptacle back to the original position is required to unlock the plug.

U.S. Pat. No. 3,942,856 to Mindheim discloses a socket assembly with a hand operated plunger in which movements are required to insert or release a plug.

U.S. Pat. No. 4,076,360 to Singh discloses an externally threaded sleevetype device surrounding at least part of an electrical connector device in which the socket and plug are covered and locked into place by the sleeve.

No device is known which is simultaneously simple to operate, inexpensive to produce and guards against the possibility of electrical shock. Furthermore, no device is known in which an electrical receptacle is de-energized unless a modified plug is inserted therein.

SUMMARY OF THE INVENTION

The aforementioned prior art problems are obviated by the device of this invention in which a safety receptacle for a two-piece duplex is disclosed. A pin is removably attached to a conventional male electric plug so that the pin extends outward in the same direction as the male plug's blades. A female electrical receptacle having at least one pair of hot/neutral slots encased in a housing, and adapted to receive the male blades, also includes a sleeve adapted to receive the pin.

A rack of a nonconductive, spring tensioned rack and pinion gear assembly is aligned to be workably connected to the pin. Each arm of a conductive pair of pivotal arms is connected at its one end to an electrical source and to the pinion. Each arm is aligned at its other end to make electrical contact with one of the pair of male blades so that when the pin is inserted into the sleeve, the pin engages and retracts the rack to a tensioned position, causing the pinion to rotate and pivot each of the arms into contact with the corresponding slot and thereby render the socket live. Removal of the male plug, and consequently the pin, causes the spring to relax, thereby urging the rack forward, causing each of the arms to pivot and break contact with the corresponding slot housing, thereby rendering the socket dead.

It is therefore an object of this invention to provide a new, improved device that is simple to use, inexpensive to manufacture and suitable for use with the conventional wall outlet and simple modified plug.

It is further an object of this invention to provide an electrical receptacle that is de-energized unless a modified plug is inserted therein.

It is another object of this invention to provide a safety receptacle of a character which permits the application of a slightly modified electrical plug in the regular manner and in the commonly used unguarded receptacle.

It is yet another object of this invention to provide a device that is convenient to leave in operation once the need for a safety receptacle has passed.

It is a further object of this invention to provide a device where insertion of a metal object will cause no damage to the receptacle or to a person inserting it.

These and other objects will be more readily ascertainable to one skilled in the art from a consideration of the following Figures and exemplary embodiments.

BRIEF DESCRIPTION OF THE DRAWING(S)

DETAILED DESCRIPTION OF THE PREFERRED EMBODIMENT(S)

Figure 1:
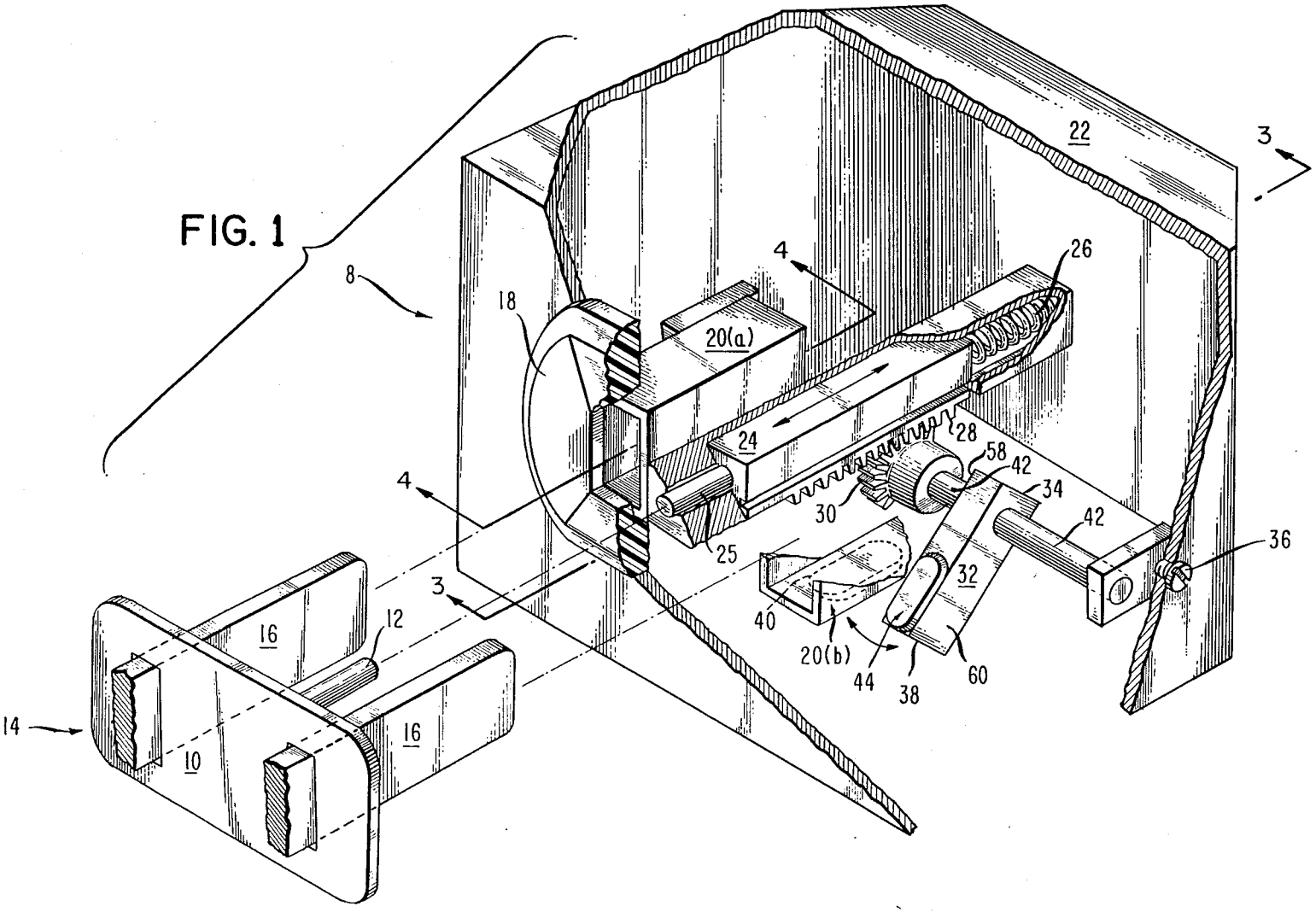
FIG. 1 is an isometric view of the device of this invention including a cutaway of the receptacle with the spring relaxed and the adapter pin on a cutaway of the plug.

Referring now to the drawings and more particularly to FIG. 1, an isometric view of device 8 is shown. Adapter 10 including pin 12 is seen attached to male plug 14 (partially cut away in this view) with pin 12 between blades 16 of plug 14. Pin 12 extends outward from male plug 14 in the same direction as blades 16.

Female electrical receptacle 18 (in cutaway) is shown with one pair of hot/neutral slots designated as **20*a* and 20*b* that are encased in nonconductive housing 22. Slots 20*a* and 20*b* are adapted to receive blades 16 of male plug 14. Sleeve 24, with its projection 25 between slots 20***a* and 20*b*, is adapted to be workably connected to pin 12 through an aperture (not shown in this Figure) between slots 20*a* and 20*b* in receptacle 18. Spring 26 is behind sleeve 24 and is shown relaxed due to the absence of pin 12. Nonconductive rack 28 is workably attached to movable sleeve 24 and nonconductive pinion 30 which is mounted between arms 32 (only one shown).

A pair of conductive parallel pivotal arms 32 (one shown) are connected at their one end 34 to electrical source 36 and to pinion 30 via a pair of rods 42. Arm 32 is aligned at its other end 38 to make electrical contact with slot 20*b*. Pinion 30 and arms 32 are mounted below rack 28 and are connected to each other by rod 42 (one of a pair shown). Electrical source 36 is connected to pivotal arm 32 by the extension of rod 42. As shown, arm 32 is connected to pinion 30 on arm's inner side 58 and to electrical source 36 on arm's outer side 60 at arm end 34. Each arm 32 terminates at its other end 38 in knob 44 which is aligned to make electrical contact with their respective slots 20 at area 40.

Figure 2:
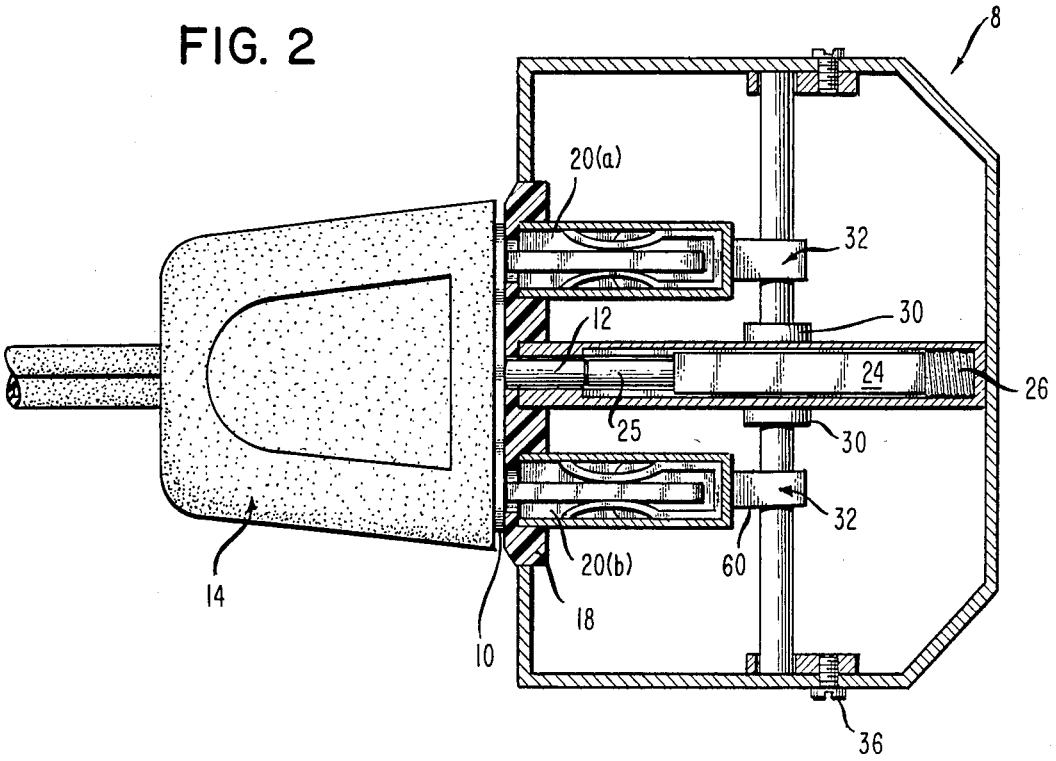
FIG. 2 is a cross sectional top view of the device of this invention including the pin inserted and the spring tensioned.

Referring now to FIG. 2, a cross section top view of device 8 is shown with plug 14 and adapter 10 inserted into receptacle 18. Pin 12 has therefore engaged sleeve 24 at its projection 25 into a tensioned position with spring 26. Rack 28 (not shown but workably connected to sleeve 24) has caused pinion 30 to rotate and pivot pair of arms 32 into contact with corresponding slots 20*a* and 20*b*, thereby rendering sockets 20*a* and 20*b* live.

Figure 3:
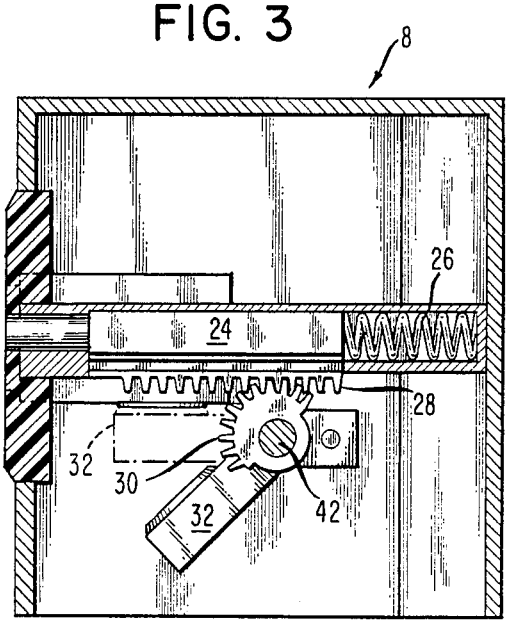
FIG. 3 is a partial cross sectional side view taken along lines 3—3 of FIG. 1 of the device of this invention showing the arms dropped out of contact with the socket and in contact with the socket in phantom.

Referring now to FIG. 3, a partial cross section side view of device 8 taken along lines 3—3 of FIG. 1 is shown with the plug and adapter removed. Spring 26 has thereby been relaxed urging rack 28 and sleeve 24 forward by the rotating of pinion 30. Arms 32 (one shown) have thereby been made to pivot and break contact with the slots (none shown in this view), thereby rendering socket slots dead. Arm 32 is shown in phantom as it would appear in FIG. 2 when the plug and pin are inserted and the socket would be live.

Figure 4:
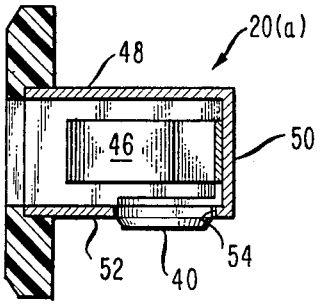
FIG. 4 is a partial cross sectional side view taken along lines 4—4 of FIG. 1 of the device of this invention showing the contact extending down through the receptacle's slot.

Referring now to FIG. 4, a cross section side view is shown of socket slot 20(*a*) taken along lines 4—4 of FIG. 1. Conductive clip 46 lines side wall 48 and end wall 50 and is exposed through bottom wall 52 at aperture 54.

Referring back to FIGS. 1 and 3, contact area 40 is thus exposed to make electrical contact with knob 44 of arm 32.

Figure 5:
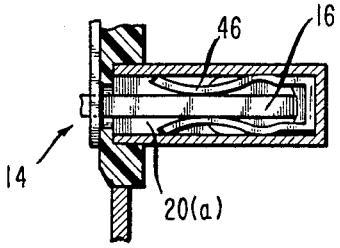
FIG. 5 is a partial cross sectional top view of the device of this invention showing the blade in contact with the slot.
Figure 6:
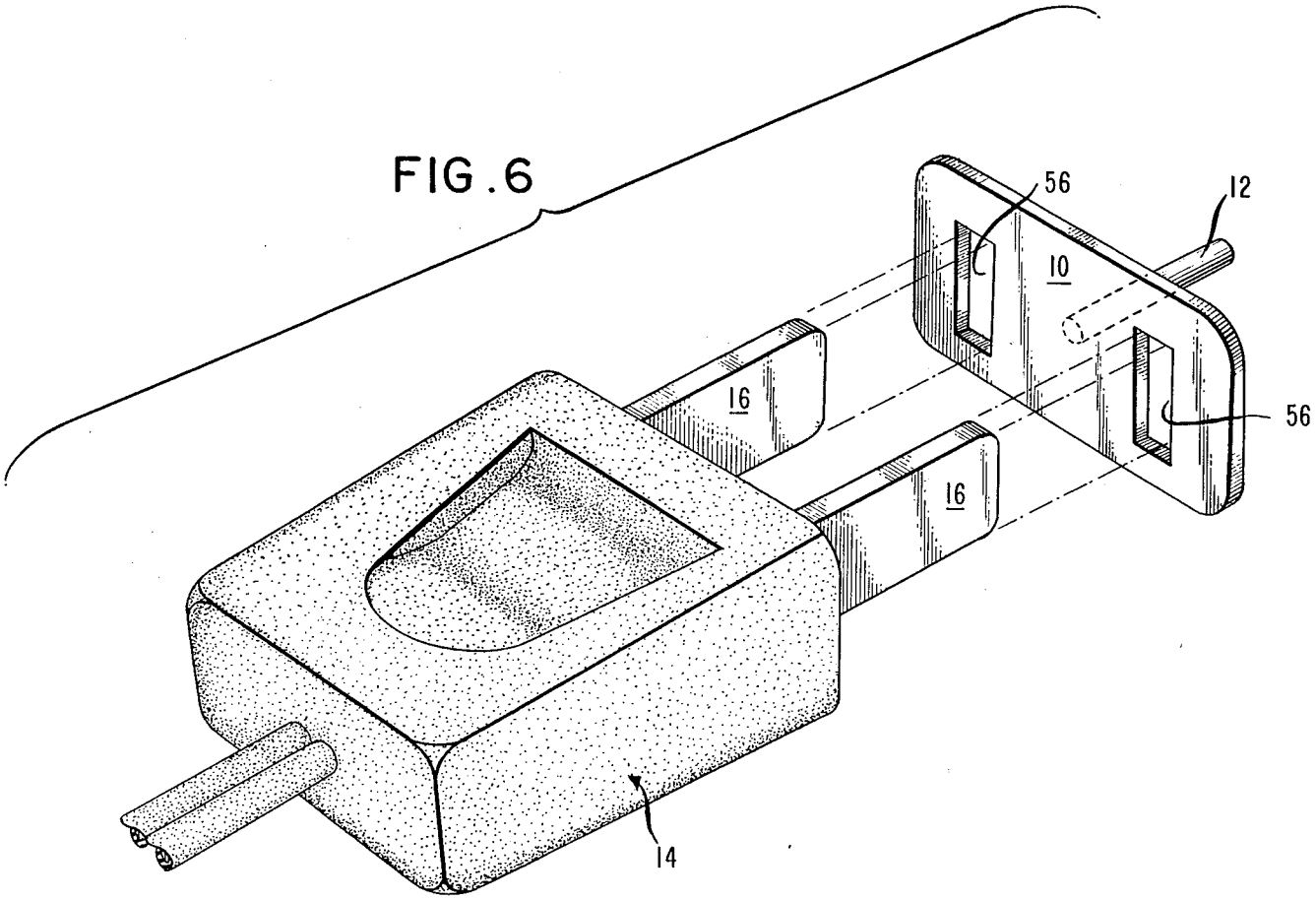
FIG. 6 is an exploded view showing the adapter in relation to its positioning on the plug.

Referring now to FIG. 5, a cross section top view is shown of a socket slot 20(*a*). Blade 16 of male plug 14 (shown in cutaway) has been inserted into slot 20(*a*). Blade 16 has contacted conductive clip 46 and the circuit would now be live. Referring now to FIG. 6, adapter 10 with pin 12 is shown exploded away from male plug 14 with its blades 16. Blades 16 fit through apertures 56 so that pin 12 extends outward from plug 14 in the same direction as blades 16.

In use, the adapter, with its pin, is attached to a male plug. When the plug is inserted into a receptacle, the pin engages and retracts the rack of a tensioned position causing the pinion to rotate and pivot each of the arms into contact with the corresponding slot and thereby render the socket live. The removal of the male plug and consequently the adapter, with its pin, causes the spring to relax, thereby urging the rack forward causing each of the arms to pivot and break contact with the corresponding slot housing, thereby rendering the socket dead.

There are many variations which may be practiced within the scope of this invention. For example, the rack and pinion may be reversed; that is, the pinion would work equally as well placed above the rack.

The placement of the pin between the plug blades is not critical, but is merely a preference in design.

The configuration of the arms and slot aperture as illustrated is merely a suggestion and is not critical to the invention. Furthermore, the configuration of any part of this device is not critical as long as it achieves the intended purpose.

The device of this invention has many advantages. Chiefly among these in the immediate power disconnect by the relaxation of the spring when the plug is merely loosened, if not totally removed.

Second, the adapter may be altered to fit any male plug.

Third, the device is simple to use, inexpensive to manufacture, and is suitable for use with the conventional wall outlet and simple modified plug.

Next, the receptacle is de-energized unless a modified plug is inserted therein.

Also, the device is convenient to leave in operation once the need for a safety receptacle has passed.

Last, the insertion of a metal object into the receptacle will cause no damage to the receptacle or the person inserting it.

Having now illustrated and described my invention, it is not my intention that such description limit the invention, but that the invention be limited only by a reasonable interpretation of the appended claims.

What is claimed is:

1. A safety receptacle and plug comprising:

(a) a male plug including two parallel blades extending outward from said plug at one plug end and an elongated pin interposed between said blades and extending from said plug end parallel to said blades; and, (b) a female receptacle including: (i) a housing having at least one pair of hot/neutral slots encased therein and adapted to receive said male plug's male blades;

(ii) a sleeve located in said housing, said sleeve having two ends and four sides and including at one sleeve end an extension to abut said pin when said plug's blades are received by said receptacle;

(iii) a nonconductive tensioned rack including a spring for tensioning, said rack in linear alignment to and abutting one of said sleeve's sides;

(iv) a nonconductive pinion workably engaging said rack; and, (v) a conductive pair of pivotal arms located in a plane parallel to said hot/neutral slots, each said arm having an inner and an outer side and two ends, each said arm connected to a first arm end to an electrical source and to said pinion, each said arm's other end aligned to pivotably make electrical contact with one each of said hot/neutral slots, so that when said male plug is inserted in said housing, said pin engages said sleeve extension and presses against said extension causing said rack to retract, whreby said pinion rotates and pivots each said arm into contact with said hot/neutral slot to thereby render said socket live, and removal of said plug, and consequently said pin, allows said spring to relax, thereby urging said rack forward to cause each said arm to pivot and discontinue contact with said slot, thereby breaking electrical contact and rendering said socket dead.

2. The device according to claim 1 wherein said sleeve is interposed between said pair of hot/neutral slots.

3. The device according to claim 1 wherein said rack is attached to one of said sleeve's sides between said spring and said sleeve extension.

4. The device according to claim 1 wherein said non-conductive pinion is connected to each said arm by one of a pair of rods, each said rod having two ends, a first end connected to said electrical source and a second end connected to said pinion.

5. The device according to claim 1 wherein said arms are parallel to each other.

6. The device according to claim 5 wherein said pinion is mounted between said arms.

7. The device according to claim 6 wherein each of said arms is connected to said pinion on said arm's inner side and connected to said electrical source on said arm's outer side at said arm's first end.

8. The device according to claim 1 wherein each of said pivotal arms terminates at its said other end in a knob aligned to make electrical contact with a corresponding hot/neutral slot.

9. The device according to claim 8 wherein each said hot/neutral slot includes, additionally, a conductive clip mounted to receive said blade and an aperture to receive said arm's knob, said blade thereby making electrical contact with said clip.

10. The device according to claim 1 wherein said housing is conductive at each said hot/neutral slot.

* * * * *